US005765359A

United States Patent [19]

Kawai et al.

[11] Patent Number: 5,765,359

[45] Date of Patent: Jun. 16, 1998

[54] ROTOR TYPE OPEN-END SPINNING MACHINE

[75] Inventors: Yasuyuki Kawai; Masashi Kaneko; Noriaki Miyamoto, all of Kariya, Japan

[73] Assignee: Kabushiki Kaisha Toyoda Jidoshokki Seisakusho, Kariya, Japan

[21] Appl. No.: 649,265

[22] Filed: May 17, 1996

[30] Foreign Application Priority Data

May 23, 1995 [JP] Japan ..... 7-124023

[51] Int. Cl.[6] ..... D01H 4/00

[52] U.S. Cl. ..... 57/414; 57/416; 57/417

[58] Field of Search ..... 57/404, 405, 414, 57/415, 416, 417

[56] References Cited

U.S. PATENT DOCUMENTS

| | | | |
|---|---|---|---|
| 3,877,211 | 4/1975 | Saveliev et al. | 57/415 |
| 3,903,683 | 9/1975 | Shino | 57/415 |
| 4,077,195 | 3/1978 | Stahlecker et al. | 57/415 |
| 4,222,225 | 9/1980 | Stahlecker et al. | 57/415 |
| 4,455,819 | 6/1984 | Suzuki et al. | 57/404 |
| 5,109,663 | 5/1992 | Stahlecker et al. | 57/415 |
| 5,359,846 | 11/1994 | Miyamoto et al. | 57/414 |
| 5,406,783 | 4/1995 | Kaneko et al. | 57/414 |
| 5,414,990 | 5/1995 | Blazek et al. | 57/414 |

FOREIGN PATENT DOCUMENTS

| | | |
|---|---|---|
| 2292783 | 6/1976 | France . |
| 4411342 | 10/1995 | Germany . |
| 51-64034 | 6/1976 | Japan . |
| 57-154424 | 9/1982 | Japan . |
| 533226 | 2/1993 | Japan . |
| 544119 | 2/1993 | Japan . |
| 1334801 | 10/1973 | United Kingdom . |

*Primary Examiner*—C. D. Crowder
*Assistant Examiner*—Tina R. Taylor
*Attorney, Agent, or Firm*—Brooks Haidt Haffner & Delahunty

[57] ABSTRACT

A rotor type open-end spinning machine of a structure in which fibers moving slidingly on an inner wall surface of an outer rotor (2) are prevented from falling at a location where a fiber bundle is being stripped off from a fiber collecting/bundling section (7) while being twisted concurrently. An inner rotor (5) is disposed within the outer rotor (2) and positively driven independently of the latter. A delivery passage (20) is formed in the inner rotor (5) for guiding a fiber bundle (F) bundled in a fiber collecting/bundling groove (7) to a yarn withdrawing passage (14). An annular negative-pressure chamber (6) is formed radially outward of the fiber collecting/bundling groove (7) of the outer rotor (2) with air discharge holes (9) being provided for communicating the negative-pressure chamber (6) to the exterior of the outer rotor (2). A plurality of air vent through-holes (8) are formed each at a location close to the delivery passage (20) with a predetermined distance therebetween in a circumferential direction for communicating an inner space defined in the outer rotor (2) to the negative-pressure chamber (6). A shield member (21) is formed on the inner rotor (5) for intercepting the air vent through-holes (8) from the negative-pressure chamber (6) except for those located in a predetermined region opposite the delivery passage (20).

11 Claims, 7 Drawing Sheets

ROTOR TYPE OPEN-END SPINNING MACHINE

BACKGROUND OF THE INVENTION

1. Field of the Invention

The present invention generally relates to a rotor type open-end spinning machine. More particularly, the invention is directed to a rotor type open-end spinning machine which includes an outer rotor provided with a fiber collecting/bundling means for collecting and forming a bundle of fibers as supplied or fed in an opened state and an inner rotor mounted internally of the outer rotor and adapted to be positively driven independently of the outer rotor, wherein the inner rotor has a portion corresponding to an end of a yarn withdrawing passage and formed with a delivery aperture or passage through which the fiber bundle is to be introduced into the yarn withdrawing passage.

2. Description of Related Art

In general, in the rotor type open-end spinning machine, a sliver, as supplied, is subjected to an opening or combing operation of a combing roller, with impurities, foreign materials or the like contained therein being eliminated, whereupon the loose fibers resulting from the opening or combing operation performed by the combing roller are transported into a rotor, being carried by air streams produced within a fiber transporting passage (also referred to as the fiber transporting channel) under the action of a negative pressure generated within the rotor which is driven rotationally at a high speed. The fibers transported into the rotor are collected in the form of a fiber bundle at a fiber collecting/bundling portion (e.g. fiber collecting/ bundling groove) constituted by a portion of the rotor at a location having a maximum inner diameter, whereupon the fiber bundle as formed is withdrawn or pulled outwardly by means of a withdrawing roller through a guide hole (yarn withdrawing passage) formed at a center of a navel, while being concurrently twisted under the action of rotation of the rotor to be thereby transformed into a yarn which is then taken up by a bobbin to form a package.

The open-end spinning machine is advantageous over the ring spinning machine in respect to the productivity (manufacturing efficiency). However, the open-end spinning machine in which the fibers collected in the form of a bundle at the fiber collecting/bundling portion of the rotor are pulled out directly through a yarn withdrawing passage suffers from a problem that when the spinning speed is increased, there takes place propagation of the twisting to a portion of the fiber bundle located upstream of a strip-off point at which the fiber bundle formed at the fiber collecting/ bundling portion is taken off therefrom. Consequently, the fibers moving slidingly on and along the inner wall surface of the rotor freely under no regulation or restriction will be loosely and irregularly wound into the rotating fiber bundle, degrading thereby the outer appearance of the yarn as manufactured, which in turn means that a cloth woven by using such yarns is also degraded in respect to the quality. Furthermore, there exists another problem that the fibers fed into the rotor from the fiber transporting passage tend to stick to the fiber bundle moving toward the yarn withdrawing passage from the fiber collecting/bundling portion while being concurrently twisted, to thereby degrade the outer appearance of the yarn.

As an apparatus for solving or mitigating the above-mentioned problems of the conventional open-end spinning machine known heretofore, there has been proposed an open-end spinning machine including a draft rotor (also referred to as the inner rotor) which is mounted at the inner side of a rotor (referred to as the outer rotor) and has a withdrawing passage for withdrawing a fiber bundle formed at the fiber collecting/bundling portion and which is adapted to rotate at a speed differing from that of the outer rotor (refer to, e.g. Japanese Unexamined Patent Application Publication No. 64034/1976 (JP-A-51-64034). In the case of the open-end spinning machine mentioned just above, the inner rotor is disposed coaxially within the outer rotor. The inner rotor is so driven as to rotate at a slightly higher speed than the outer rotor, wherein the fiber bundle F is withdrawn through the withdrawing passage formed in the inner rotor, while being concurrently drafted. Furthermore, in Japanese Unexamined Patent Application Publication No. 154424/1982 (JP-A-57-154424), there is disclosed a spinning machine in which a means for generating an eddy air stream within the inner rotor, wherein the fiber bundle formed at the fiber collecting/bundling portion of the outer rotor is withdrawn, and sucked into the inner rotor and rotated under the action of the air eddy stream.

In the open-end spinning machine equipped with the inner rotor, as described above, the problem that the fibers or filaments fed into the rotor from the fiber transporting passage are wound or taken into the fiber bundle extending from the fiber collecting/bundling portion to the yarn withdrawing passage while being twisted, to thereby degrade the outer appearance of the yarn as manufactured, can certainly be solved to a satisfactory extent. However, in the rotor type open-end spinning machine, the fibers f positioned, straddling across the strip-off point P, as illustrated FIG. 12A, tend to move toward the center of a rotor 60 in accompanying the withdrawal of the fiber bundle F (see FIG. 12B), incurring thus winding of the fibers into or around the fiber bundle F in a coil-like fashion (see FIG. 12C) at a location downstream of the take-off or strip-off point P. As a result of this, bending rigidity of the yarn as manufactured tends to increase, imparting hard or uncomfortable feel to the cloth woven by using such yarns. Of course, the outer appearance of the yarn will be degraded, giving rise to a problem.

SUMMARY OF THE INVENTION

In the light of the state of the art described above, it is an object of the present invention to provide a rotor type open-end spinning machine of an improved structure in which fibers moving slidingly on an inner wall surface (i.e., fiber capturing surface) of an outer rotor are prevented from falling onto the location where a fiber bundle is stripped off from a fiber collecting/bundling portion while being twisted concurrently, to thereby improve the outer appearance of the yarn as spun as well as the feel out of the cloth woven by using such yarns.

In view of the above and other objects which will become apparent as the description proceeds, there is provided according to an aspect of the present invention a rotor type open-end spinning machine which includes an outer rotor having a fiber collecting/bundling portion at which fibers supplied in an opened state are collected and bundled, an inner rotor disposed within the outer rotor and adapted to be positively driven independently of the outer rotor, and a yarn withdrawing passage. The inner rotor is further provided with a delivery aperture for receiving the fiber bundle fed from the fiber collecting/bundling portion to thereby introduce the fiber bundle into the yarn withdrawing passage, the delivery aperture being so formed as to have a portion which is communicated to an end of the yarn withdrawing passage. The rotor type open-end spinning machine further includes a fiber move regulating means for regulating or restricting temporarily movement of the fibers placed on the inner wall surface of the outer rotor and moving toward the fiber collecting/bundling portion at a location corresponding to the delivery aperture formed in the inner rotor as well as at a location in the vicinity of that aperture.

In a preferred mode for carrying out the invention, the fiber move regulating means may be comprised of an annular negative-pressure chamber provided in association with the outer rotor at the outside of the fiber collecting/bundling portion, discharge holes formed in the outer rotor so as to communicate the negative-pressure chamber to the exterior of the outer rotor, air vent through-holes formed in the outer rotor in a circumferential direction with a predetermined distance therebetween for communicating an inner space of the outer rotor and the negative-pressure chamber to each other, and a shield member provided in association with the inner rotor so as to cover the air vent through-holes except for those formed in a predetermined region corresponding to the delivery aperture.

In the open-end spinning machine described above, the opened fibers fed into the outer rotor from the fiber transporting passage move slidingly on an inner wall surface of the outer rotor to be collected and bundled in the fiber collecting/bundling portion, wherein one end of the fiber bundle collected in the fiber collecting/bundling portion extends continuously to the yarn which is being withdrawn by a withdrawing roller. The fiber bundle stripped off from the fiber collecting/bundling portion is then guided into the yarn withdrawing passage by way of the inner rotor while being twisted, to be transformed into a yarn which is delivered as a product.

The fibers moving slidingly toward the fiber collecting/bundling portion after having been placed on the inner wall surface of the outer rotor undergo temporarily or transiently regulation or restriction of movement at a location corresponding to the delivery aperture formed in the inner rotor or at a location in the vicinity thereof. Thus, the fibers moving slidingly are prevented from falling onto the strip-off point at which the fiber bundle is taken off from the fiber collecting/bundling passage. In this manner, winding or sticking of the fibers into the fiber bundle being currently twisted can be suppressed, which may otherwise degrade the outer appearance of the yarn as manufactured as well as the feel of the cloth woven by using such yarns.

Further, in the open-end spinning machine including the fiber move regulating means, there are generated air streams flowing toward the annular negative-pressure chamber through the air vent through-holes formed at locations closer to the open side of the outer rotor than the fiber collecting/bundling portion, whereby movement or displacement of the fibers sliding on the inner wall surface of the outer rotor toward the fiber collecting/bundling portion is temporarily or transiently regulated or restricted. In that case, the air vent through-holes formed at the other positions than those within the predetermined region which corresponds to the delivery aperture of the inner rotor and those in the vicinity of that aperture are covered by the shield member formed in the inner rotor, whereby generation of the air streams flowing toward the negative-pressure space is suppressed to allow the fibers to move smoothly on and along the aforementioned inner wall surface. Because of the regulation or restriction of movement of the fibers in the predetermined region mentioned above, the fibers are effectively inhibited from falling on the strip-off point or location where the fiber bundle is taken off from the fiber collecting/bundling portion and withdrawn while being concurrently twisted.

In another preferred mode for carrying out the invention, the inner rotor may have an annular flange disposed in opposition to a bottom of the outer rotor. The shield member may be formed of a plate-like member extending from a portion of a peripheral edge of the annular flange in a direction away from the bottom of the outer rotor.

In yet another preferred mode for carrying out the invention, the fiber collecting/bundling portion may be provided with a plurality of second air vent through-holes formed at positions corresponding to the bottom of the fiber collecting/bundling portion.

In still another preferred mode for carrying out the invention, the fiber collecting/bundling portion may be either comprised of a recessed groove formed in the inner wall surface of the outer rotor or formed by bending the inner wall surface of the outer rotor.

In a further preferred mode for carrying out the invention, it is advantageous to implement the delivery aperture in the form of a passage extending substantially continuously to the yarn withdrawing passage.

According to another aspect of the present invention, there is provided a rotor type open-end spinning machine which includes an outer rotor having a fiber collecting/bundling portion at which fibers supplied in an opened state are collected and bundled, an inner rotor disposed within the outer rotor and adapted to be positively driven independently of the outer rotor, and a yarn withdrawing passage. The inner rotor is further provided with a delivery aperture for receiving the fiber bundle fed from the fiber collecting/bundling portion to thereby introduce the fiber bundle into the yarn withdrawing passage, the delivery aperture being so formed as to have a portion which is communicated to an end of the yarn withdrawing passage. The fiber collecting/bundling portion is provided at a location closer to the open side of the outer rotor than a location corresponding to the delivery aperture of the inner rotor and provided with a wall formed such that a diameter thereof decreases in a direction toward a bottom of the outer rotor from the fiber collecting/bundling portion. The wall is provided with a guide groove for withdrawing the fiber bundle at a position corresponding to the delivery aperture of the inner rotor.

In the open-end spinning machine described above, the opened fibers fed into the outer rotor from the fiber transporting passage move slidingly on an inner wall surface of the outer rotor to be collected and bundled in the fiber collecting/bundling portion. The delivery aperture of the inner rotor is provided at a position opposite to the guide groove formed closer to the bottom of the outer rotor than the fiber collecting/bundling portion, whereby the fiber bundle collected and bundled at the fiber collecting/bundling portion is introduced into the yarn withdrawing passage by way of the guide groove from the delivery aperture. Because of reduction of the diameter in the direction from the fiber collecting/bundling portion toward the guide groove, displacement of the fibers is difficult to take place, while the twisting of the fiber bundle within the guide groove can effectively be prevented from propagation to the fiber collecting/bundling portion under the action of contact pressure exerted by the diameter decreased or tapered wall. Thus, the sticking of the fibers into the fiber bundle at the fiber collecting/bundling portion can be suppressed. In this manner, fibers moving slidingly on the inner wall surface of the outer rotor (i.e., fiber capturing surface) are prevented from falling on at a location where the fiber bundle is stripped off from the fiber collecting/bundling portion while being twisted concurrently. Thus, the outer appearance of the yarn as spun as well as the feel of the cloth woven by using such yarns can be improved.

In a yet further preferred mode for carrying out the invention, a plurality of air vent through-holes may be formed in the outer rotor with a predetermined distance therebetween in a circumferential direction thereof between the fiber collecting/bundling portion of the outer rotor and the guide groove. By virtue of the structure mentioned above, there take place air streams flowing through the air vent through-holes formed between the fiber collecting/bundling portion and the guide groove. Thus, tendency of a part of the fibers bundled at the fiber collecting/bundling portion to move toward the guide groove is restricted or regulated. Thus, the fiber bundle formed at the fiber collecting/bundling portion can be withdrawn by way of the guide groove without fail.

In still further preferred modes for carrying out the invention, the outer rotor and the inner rotor may have coaxial center axes around which these rotors are rotated, respectively, wherein a generating line of the inner annular surface of the outer rotor extending between the fiber collecting/bundling portion and the guide groove may extend in parallel with the center axis. Alternatively, the generating line of an inner annular surface of the outer rotor extending from the peripheral edge at the open side of the outer rotor to the guide groove may be formed by a single straight line.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
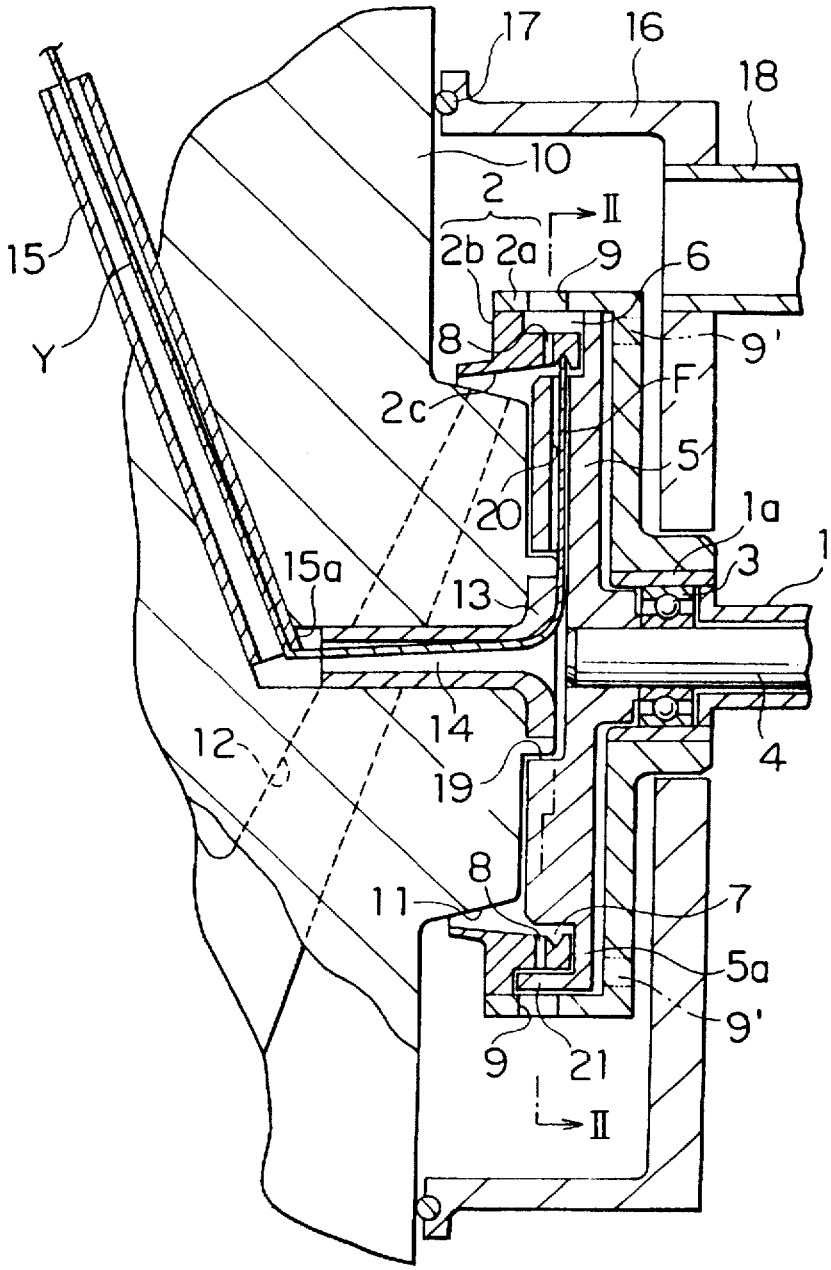
FIG. 1 is a fragmentary sectional view for illustrating partially a structure of an open-end spinning machine according to a first embodiment of the present invention.

Now, the present invention will be described in detail in conjunction with what is presently considered as preferred or typical embodiments thereof by reference to the drawings. In the following description, like reference characters designate like or corresponding parts throughout the several views. Also in the following description, it is to be understood that such terms as "left", "right", "bottom" and the like are words of convenience and are not to be construed as limiting terms. Instead, the terms are used to reference components as seen by the reader when looking at the various Figures of the drawings. As will be seen from the accompanying drawings, the outer rotors are generally cup-shaped. For purpose of reference, the mouth of the cup is referred to as the "open end" while the bottom of the cup is referred to as the "closed end". The side wall of the cup may be referred to as a "cylindrical" or "peripheral" wall joined to the closed end.

Embodiment 1

Now, a rotor type open-end spinning machine according to a first exemplary embodiment incorporating the teachings of the present invention will be described by reference to FIGS. 1 to 3. First referring to FIG. 1, an outer rotor 2 is fixedly mounted on a tip end portion of a hollow rotor shaft 1 so as to rotate therewith, wherein the rotor shaft 1 is rotatably supported in a machine frame (not shown) of a structure known per se (see, e.g. Japanese Unexamined Patent Application Publications Nos. 33226/1993 (JP-A-5-33226), 44119/1993 (JP-A-5-44119) and others, if necessary) and adapted to be rotationally driven by a driving means (not shown either). The rotor shaft 1 has increased-diameter portions 1*a* formed at both ends hereof, respectively, (although only one end portion is shown), wherein a bearing 3 is secured at each of the increased-diameter portions la of the rotor shaft 1. A shaft 4 extending through the rotor shaft 1 is supported by means of the bearings 3 (only one of which is shown) so as to be rotatable coaxially with the rotor shaft 1. An inner rotor 5 is fixedly secured to a tip end portion of the shaft 4 to be rotatable together with the latter, wherein the shaft 4 has a base end which bears against a thrust bearing, although not shown. Needless to say, the shaft 4 is also adapted to be rotationally driven by a driving means known per se, independently of the rotor shaft 1, in the same direction as the outer rotor 2.

The outer rotor 2 is comprised of a main body 2*a* mounted snugly and fixedly on the rotor shaft 1 at the increased diameter portion 1*a* and an annular member 2*b* mounted on the main body 2*a* by a press-fitting or the like appropriate means, wherein a negative-pressure chamber 6 serving as an annular negative-pressure applying means is defined between the annular member 2*b* and the main body 2*a*. Formed in an inner wall surface of the annular member 2*b* along a location having a maximum inner diameter is a fiber collecting/bundling groove 7 which is to serve as a fiber collecting/bundling means, wherein an inner wall surface of the annular member 2*b* located closer to the open end or side of the outer rotor 2 than the fiber collecting/bundling groove 7 constitutes a fiber capturing surface 2*c*. More specifically, the fiber capturing surface 2*c* is so formed that the inner diameter thereof increases progressively toward the fiber collecting/bundling groove 7 from the open end or side of the outer rotor 2 (i.e., the fiber capturing surface 2*c* is tapered leftwards, as viewed in FIG. 1) wherein a plurality of air vent through-holes 8 are formed in the annular wall of the annular member 2b at positions closer to the open end or side of the outer rotor 2 than the fiber collecting/bundling groove 7 with a predetermined distance between the holes 8 in the circumferential direction of the outer rotor 2 in order to ensure air-flow communication between the interior or inner space of the outer rotor 2 and the negative-pressure chamber 6. On the other hand, a plurality of air discharge holes 9 are formed in the main body 2a of the outer roller 2 for the purpose of establishing a fluidal communication between the negative-pressure chamber 6 located at the outer side of the fiber collecting/bundling groove 7 and the exterior space of the outer rotor 2. In the case of the instant embodiment of the invention, the air discharge holes 9 are formed with an equi-distance therebetween in the circumference direction of the peripheral wall 2a of the outer rotor 2.

Disposed at a position opposite to the open side of the outer rotor 2 is a housing 10 which has a boss portion 11 formed in such disposition that it extends or projects into the inner space of the outer rotor 2. In a peripheral surface of the boss portion 11, there is formed an opening of a fiber transporting channel 12 which serves as a fiber transporting passage for guiding fibers combed/opened by a combing roller (not shown) into the outer rotor 2. A navel member 13 is secured to the boss portion 11 at a center thereof, wherein one end of a yarn withdrawing passage 14 for guiding a yarn Y formed by the spinning machine to a take-up apparatus (not shown) is opened in the navel 13 at a center portion thereof. A yarn pipe 15 constituting a part of the yarn withdrawing channel is disposed in such a state that the yarn pipe 15 intersects a center axis of the navel member 13, wherein an end portion 15a of the yarn pipe 15 located closer to the navel member 13 defines a position at which twisting operation for a fiber bundle F is started. Furthermore, there is disposed at a position opposite to the housing 10 a casing 16 for covering the outer rotor 2 in such disposition that the casing 16 abuts an outer wall surface of the housing 10 with an O-ring 17 being interposed therebetween. The casing 16 is connected to a negative pressure source (not shown) by way of a pipe 18.

The inner rotor 5 is formed in a disk-like shape and has a peripheral surface portion located in the vicinity of the fiber collecting/bundling groove 7. Furthermore, the inner rotor 5 has a flange 5a having an outer diameter substantially equal to that of the negative-pressure chamber 6, wherein the flange 5a faces oppositely to the bottom wall of the outer rotor 2. Formed in a center portion of the inner rotor 5 at the side facing the boss portion 11 is a recess 19 in which a portion of the navel member 13 is accommodated loosely. A passage 20 for introducing the fiber bundle into the yarn withdrawing passage 14 is so formed as to extend from a position opposite the fiber collecting/bundling groove 7 to the inner space of the recess 19. As can be seen in FIGS. 1 and 2, the flange 5a is provided with a projecting shield member 21 for covering the air vent through-holes 8 at the side of the negative-pressure chamber 6 except for those holes 8 which are located within a predetermined range which corresponds to the delivery passage 20. In the case of the open-end spinning machine according to the instant embodiment of the invention, the shield member 21 is so dimensioned as to have a notched portion of a length sufficiently for allowing approximately five air vent through-holes 8 to be simultaneously exposed or opened so that they can be put into air flow communication with the bundle delivery passage 20. The negative-pressure chamber 6, the air vent through-holes 8, the air discharge hole 9 and the shield member 21 cooperate to constitute a fiber move controlling or regulating means.

Figure 2:
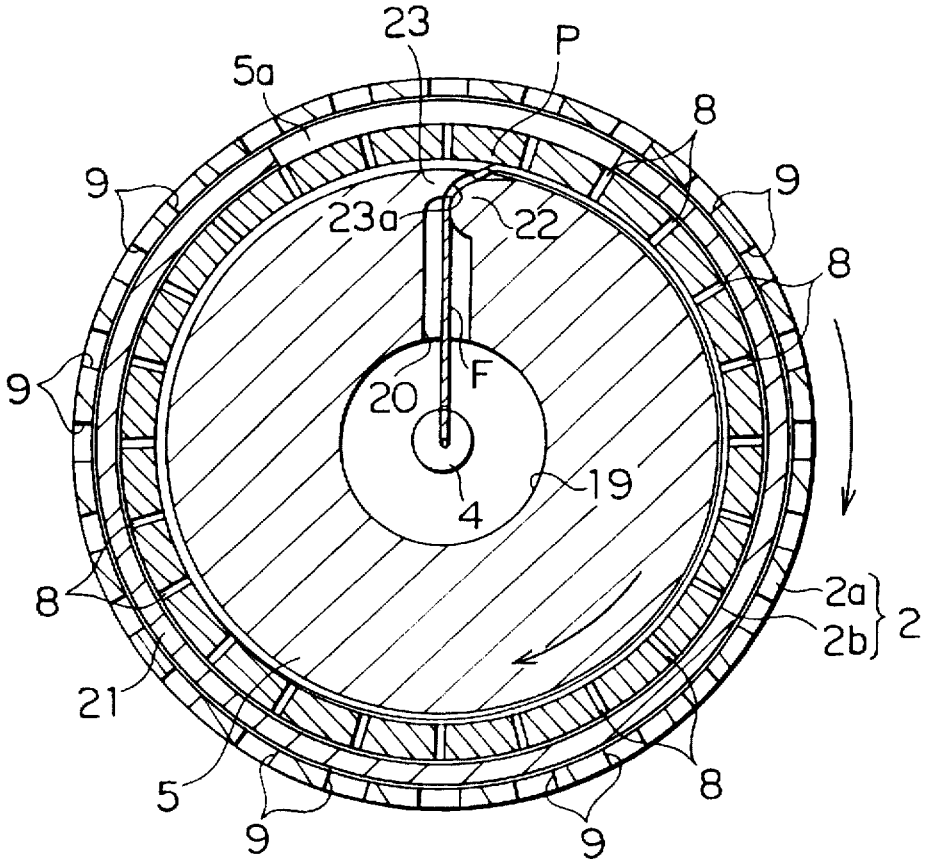
FIG. 2 is a sectional view taken along a line II—II shown in FIG. 1.
Figure 3:
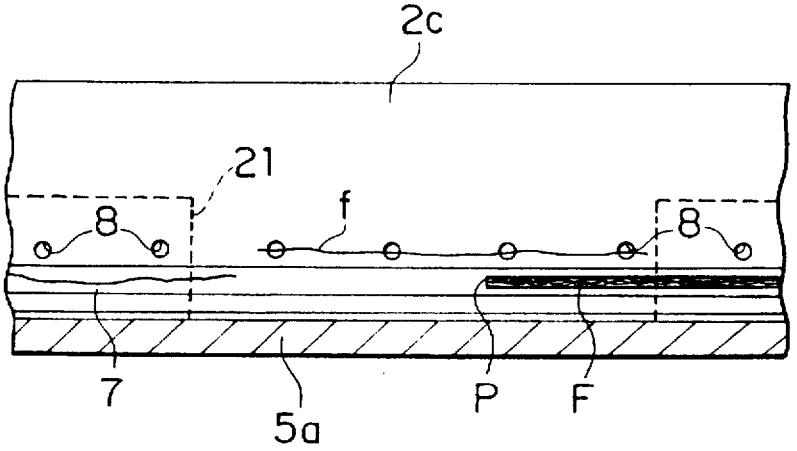
FIG. 3 is a schematic diagram for illustrating advantageous effect or operation of the open-end spinning machine according to the first embodiment of the invention.

As is shown in FIG. 2, a guide 22 of a semi-cylindrical form is disposed at a position located closer to the fiber collecting/bundling groove 7 obliquely in the direction in which the inner rotor 5 is rotated in such orientation that the guide 22 can be brought into contact with the fiber bundle F introduced into the yarn withdrawing passage 14 from a position offset in the rotating direction of the inner rotor 5. Further, a wall 23 having a concave wall surface 23a extending along an arcuate surface of the guide 22 is formed oppositely to a convex arcuate surface of the guide 22. A tip end portion of the wall 23 is so formed as to be bent in the rotating direction of the inner rotor 5 from to the arcuate surface of the guide 22. The inner rotor 5 is formed of a metal (such as, for example, aluminum or an alloy thereof) in an integral structure, wherein surfaces of the guide 22 and the wall 23 are coated with a layer (not shown) having high hardness such as a plated chrome layer, a titanium nitride layer or the like which is excellent in respect to the wear resistance. Such coating layer may be formed by resorting to a surface processing such as plating, ion plating or the like.

Now, description will be directed to operation of the rotor type open-end spinning machine implemented in the structure described above. In the spinning operation, the outer rotor 2 and the inner rotor 5 are rotated independently of each other in the same direction by way of the hollow rotor shaft 1 and the shaft 4, respectively. The rotating speed of the inner rotor 5 differs from that of the outer rotor 2 and is rotated at a speed at which the fiber bundle F can be stripped or removed from the fiber collecting/bundling groove 7 (i.e., at a speed slightly higher than the rotation speed of the outer rotor 2). In this state, the fibers or filaments as opened under the action or operation of the combing roller and fed through from the fiber transporting channel 12 into the outer rotor 2 are first placed on the fiber capturing surface 2c of the outer rotor 2 and then forced to slide along the fiber capturing surface 2c in the direction toward the fiber collecting/bundling groove 7 to be formed into a fiber bundle F. The fiber bundle F collected and bundled in the fiber collecting/bundling groove 7 extends continuously to the yarn Y which is being withdrawn by means of a withdrawing roller (not shown) through the yarn pipe 15. Thus, as the yarn Y is withdrawn, the fiber bundle F is stripped off from the fiber collecting/bundling groove 7 to be subsequently guided into the yarn withdrawing passage 14 by means of the inner rotor 5 while being twisted under the action of the outer rotor 2 being rotated, to be delivered as the yarn Y. In this conjunction, it is to be noted that the twisting action applied to the yarn Y and the fiber bundle F is started from the position corresponding to the end 15a of the yarn pipe 15 and transmitted to the fiber bundle being formed in the fiber collecting/bundling groove 7 of the outer rotor 2.

During the operation of the open-end spinning machine, the air within the inner space of the outer rotor 2 is evacuated through the air discharge holes 9 under the action of the negative pressure prevailing within the casing 16, whereby the negative-pressure chamber 6 is maintained at a negative pressure. Because of the negative pressure maintained within the negative-pressure chamber 6, there are produced air streams which flow from the inner space or interior of the outer rotor 2 to the exterior thereof through the exposed air vent through-holes 8 located at the positions not covered by the shield member 21. Thus, the exposed air vent through-holes 8 give rise to the action of suction at the fiber capturing surface 2c. As a consequence, the fibers f moving toward the fiber collecting/bundling groove 7 on and along the fiber capturing surface 2c are caused to stop the movement thereof under the action of the suction exerted by the air vent through-holes 8 located at the positions which are not covered by the shield member 21, as can best be seen in FIG. 3. When the air vent through-holes 8 are covered or shielded by the shield member 21 as it moves, the air streams flowing into the negative-pressure chamber 6 through the air vent through-holes 8 as covered are blocked, with the action of suction being cleared. As a result of this, the fibers or filaments can restart displacement or movement toward the fiber collecting/bundling groove 7. Parenthetically, FIG. 3 is a developed view for illustrating only schematically the physical relations among the fiber collecting/bundling groove 7, the air vent through-holes 8 and the fiber capturing surface 2*c*.

Thus, at the strip-off point P where the fiber bundle F is stripped off or removed from the fiber collecting/bundling groove 7 and where the action of such shield member 21 is not effective or in the vicinity of the strip-off point P, movement of the fibers or filaments displacing toward the fiber collecting/bundling groove 7 on and along the fiber capturing surface 2*c* are subjected to regulation or restriction under the action of the air streams flowing outwardly through the air vent through-holes 8, whereby the fibers moving on the fiber capturing surface 2*c* is prevented from dropping to the strip-off point P for the fiber bundle F. In this way, winding or sticking of the fibers or filaments into the fiber bundle F being withdrawn and twisted concurrently can positively be prevented, which in turn means that deterioration in the quality or outer appearance of the yarn as produced can be suppressed successfully and satisfactorily.

In the rotor type open-end spinning machine according to the instant embodiment of the invention, the fiber bundle F stripped off from the fiber collecting/ bundling groove 7 is introduced into the yarn withdrawing passage 14 while being maintained in the state contacting the wall 23 and the guide 22 (see FIG. 2). Thus, an angle formed between the direction in which the fiber bundle F is passing by the strip-off point (or the twisting start point, to say in another way) P or in the vicinity thereof and the direction in which the fiber bundle F collected within the fiber collecting/ bundling groove 7 extend is an obtuse angle. In other words, the twist angle is obtuse. Thus, difference between the paths along which the inner side and the outer side of the fiber bundle F being twisted flow, respectively, while being concurrently stripped off from the fiber collecting/bundling groove 7 is significantly small, which is advantageous in that the fiber bundle F is twisted with a substantially uniform force over the whole length thereof in the state where the fibers are stretched substantially straightly, whereby the yarn as produced is imparted with an outer peripheral surface of high quality with roughness thereof being reduced to a minimum. It goes without saying that a fabric or cloth woven by using such yarns can equally be significantly improved in respect to the outer appearance as well as the feel.

Embodiment 2

Figure 4:
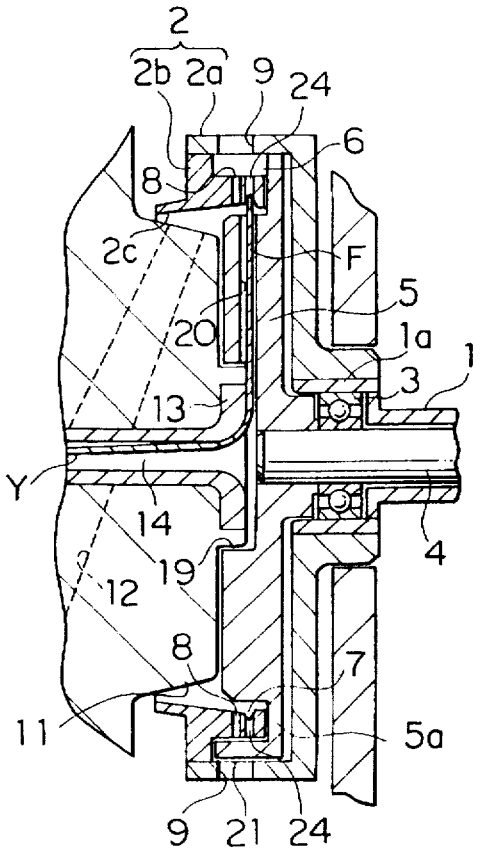
FIG. 4 is a fragmentary sectional view showing a structure of an open-end spinning machine according to a second embodiment of the invention.

Next, the rotor type open-end spinning machine according to a second embodiment of the present invention will be described by reference to FIG. 4. The open-end spinning machine according to the instant embodiment differs from the first embodiment in that a plurality of air vent through-holes 24 are formed at positions corresponding to the bottom of the fiber collecting/bundling groove 7 of the annular member 2*b* constituting a part of the outer rotor 2. Except for this structural difference, the second embodiment is essentially identical with that of the spinning machine according to the first embodiment described previously. Accordingly, same or like parts as those of the open-end spinning machine according to the first embodiment are denoted by like reference characters and repetitive description thereof is omitted.

During operation of the spinning machine according to the second embodiment of the invention, the air within the inner space of the outer rotor 2 is discharged through the air discharge holes 9 under the influence of the negative pressure within the casing 16, which results in that a negative pressure prevails within the negative-pressure chamber 6. As a result of this, air streams flowing through the air vent through-holes 24 from the fiber collecting/bundling groove 7 are generated, whereby the fiber bundle F bundled in the fiber collecting/bundling groove 7 is pressed against the bottom wall of the groove 7. Consequently, propagation or transmission of the twisting to the fiber bundle F formed within the fiber collecting/ bundling groove 7 upstream beyond the strip-off point P is suppressed, which is effective to prevent the free fibers sliding toward the fiber collecting/ bundling groove 7 on and along the fiber capturing surface 2*c* from being loosely wound around the rotating fiber bundle F, whereby outer appearance of the yarn as produced can positively be protected from deterioration. Of course, similar advantageous actions and effects as those of the spinning machine according to the first embodiment can be realized with the spinning machine according to the instant embodiment of the invention.

Embodiment 3

Figure 5:
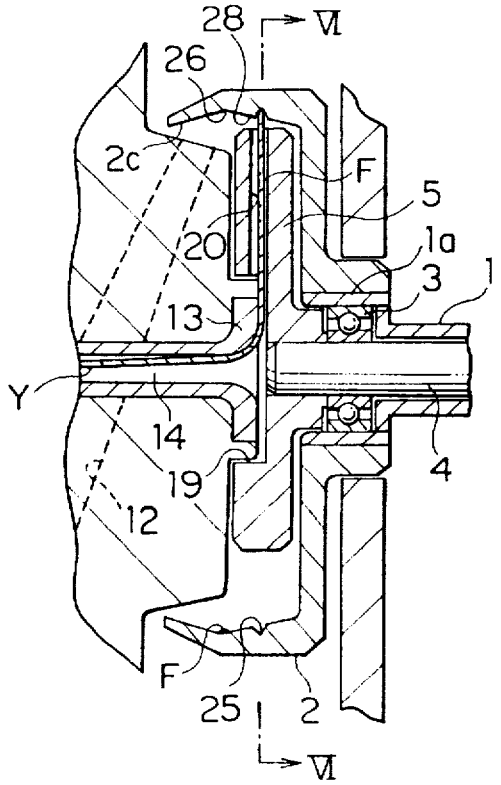
FIG. 5 is a fragmentary sectional view showing a structure of an open-end spinning machine according to a third embodiment of the invention.
Figure 6:
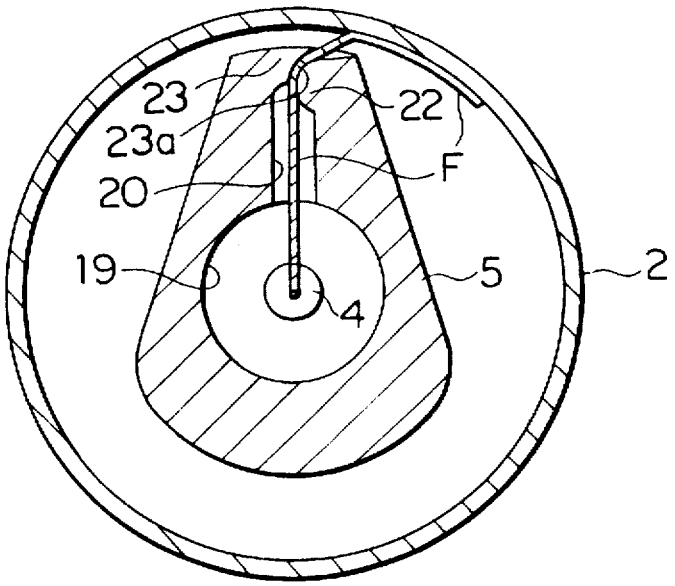
FIG. 6 is a sectional view taken along a line VI—VI shown in FIG. 5.
Figure 7:
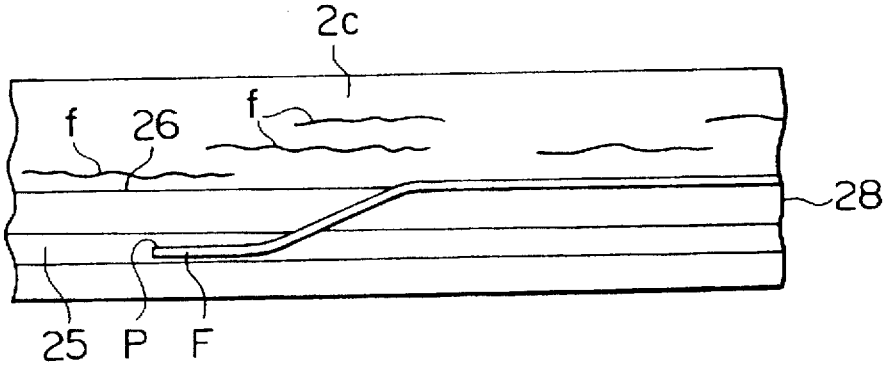
FIG. 7 is a schematic diagram for illustrating operation of the open-end spinning machine according to the third embodiment of the invention.

A rotor type open-end spinning machine according to a third embodiment of the present invention will be elucidated by reference to FIGS. 5 to 7. The open-end spinning machine according to the instant embodiment differs primarily from the spinning machines described hereinbefore in conjunction with the first and second embodiments in that the fiber collecting/bundling portion is disposed at a position closer to the open side or end of the outer rotor 2 than that of the inner rotor 5 and that the fiber move regulating means for regulating or controlling the displacement of the fibers moving on and along the fiber capturing surface 2*c* toward the fiber collecting/bundling means is not provided. Accordingly, same or like parts as those of the open-end spinning machines described hereinbefore are denoted by like reference characters and repetitive description thereof is omitted.

As can be seen in FIG. 6, the inner rotor 5 is not formed in a disk-like shape but in such a configuration that a peripheral portion of the inner rotor 5 partially extends to a position located near to the annular inner wall of the outer rotor 2 and the bundle delivery passage 20 is formed in a maximum-diameter portion of the inner rotor 5. On the other hand, formed in the outer rotor 2 at a position corresponding to that of the passage 20 of the inner rotor 5 is a guide groove 25 for withdrawing the fiber bundle, wherein the fiber collecting/bundling portion 26 is provided at a position closer to the open side of the outer rotor 2 than the guide groove 25. The inner wall surface of the outer rotor 2 is so formed that the diameter thereof decreases gradually from the fiber collecting/bundling portion 26 toward the guide groove 25 and that a portion of the annular inner wall of the outer rotor 2 extending from the fiber collecting/bundling portion 26 toward the open end of the rotor 2 serves as the fiber capturing surface 2*c* while a reduced-diameter wall 28 is formed closer to the closed end of the outer rotor.

In the case of the spinning machine according to the instant embodiment of the invention, the fibers undergone the opening operation and fed through the fiber transporting channel 12 into the outer rotor 2 move slidingly on and along the fiber capturing surface 2c to be collected at the fiber collecting/bundling portion 26. The fiber bundle F formed at the fiber collecting/bundling portion 26 extends continuously to the yarn Y being withdrawn through the yarn pipe 15 after having been stripped off from the fiber collecting/bundling portion 26 as the fiber bundle is fed through the delivery passage 20 into the yarn withdrawing passage 14 by way of the guide groove 25 and finally withdrawn as the yarn Y after having undergone twist under the action of the rotating outer rotor 2.

The fibers f placed or deposited on the fiber capturing surface 2c can move toward the fiber collecting/ bundling portion 26 on and along the fiber capturing surface 2c. However, the fibers f can not easily move slidingly in the direction toward the guide groove 25 because of the presence of an obstacle due to the reduced-diameter wall 28. The twist applied to the fiber bundle F at the guide groove 25 can propagate in the direction upstream beyond the strip-off point P, as can be seen in FIG. 7. However, because the propagation is enfeebled due to the contact pressure exerted by the reduced-diameter wall 28, the effect of the twisting operation is unlikely to reach the fiber bundle located in the fiber collecting/bundling portion 26. Even when the fiber bundle should be twisted more or less at the reduced-diameter wall 28, it is possible to move slidingly the fiber bundle formed at the fiber collecting/bundling portion 26 on and along the reduced-diameter wall 28 owing to inter-fiber friction, to thereby move the fiber bundle into the guide groove 25. In this manner, propagation of the twisting action exerted onto the fiber collecting/bundling portion 26 can positively be suppressed, whereby sticking of dust or fly fibers or filaments to the yarn during the twisting operation can be suppressed satisfactorily. Thus, the outer appearance of the yarn as produced can be protected against degradation or deterioration.

Embodiment 4

Figure 8:
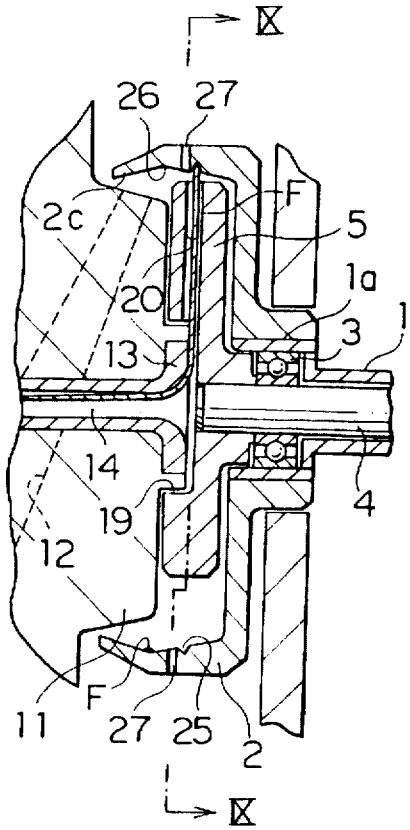
FIG. 8 is a fragmentary sectional view showing a structure of an open-end spinning machine according to a fourth embodiment of the invention.
Figure 9:
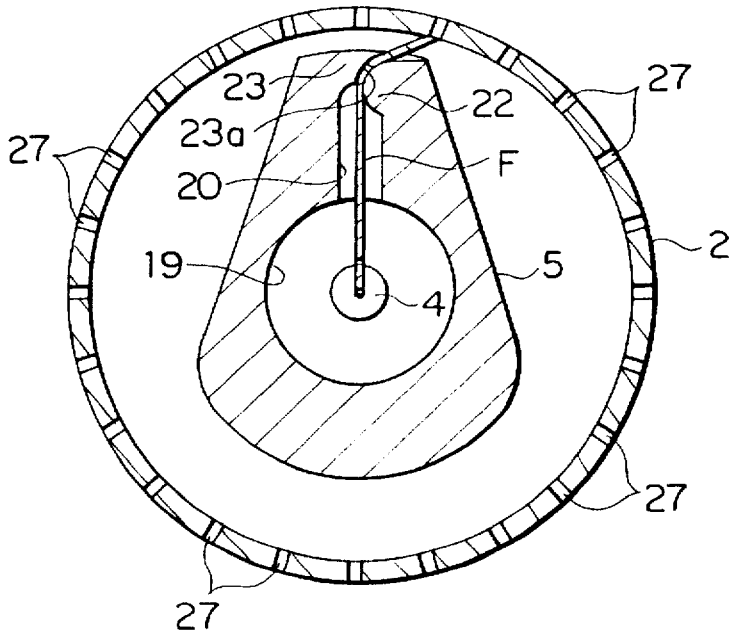
FIG. 9 is a fragmentary sectional view of the same taken along a line IX—IX shown in FIG. 8.

Next, a rotor type open-end spinning machine according to a fourth embodiment of the present invention will be described by reference to FIGS. 8 and 9. The open-end spinning machine according to the instant embodiment differs from the third embodiment in that a plurality of air vent holes 27 extending through the outer rotor 2 are formed at positions between the guide groove 25 and the fiber collecting/bundling portion 26 with a predetermined distance in the circumferential direction. Except for this structural difference, the fourth embodiment has a substantially same structure as that of the spinning machine according to the third embodiment.

In the open-end spinning machine according to the instant embodiment of the invention, there are produced air streams flowing from the interior of the outer rotor 2 to the exterior through the air vent through-holes 27, as a result of which tendency for a part of the fibers collected at the fiber collecting/bundling portion 26 to move toward the guide groove 25 is regulated or suppressed. The fiber bundle F formed at the fiber collecting/bundling portion 26 can be withdrawn through the guide groove 25 under the pulling force of the fiber bundle F being withdrawn through the passage 20 formed in the inner rotor 5. In respect to the other actions and effects, for the spinning machine according to the instant embodiment of the invention, they are substantially the same as those of the machine described hereinbefore in conjunction with the third embodiment.

Modifications

Although the present invention has been described in conjunction with what is presently considered preferable, the present invention may be modified without departing from the true spirit and scope of the invention. In other words, since numerous modifications and combinations will readily occur to those skilled in the art, it is not intended to limit the invention to the exact constructions and operations illustrated and described. By way of example, the invention may be carried out in such modes as described below.

Figure 10A:
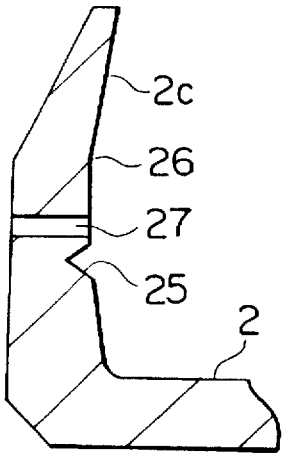
FIGS. 10A and 10B are partial sectional views showing modifications, respectively, of the invention.
Figure 10B:
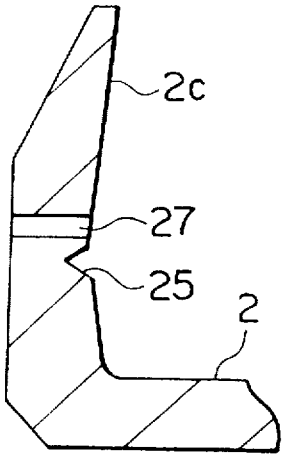

(1) In the open-end spinning machine according to the fourth embodiment, the surface between the fiber collecting/ bundling portion 26 and the guide groove 25 may be so formed as to extend in parallel with the rotor shaft 1, as shown in FIG. 10A. Alternatively, the fiber capturing surface 2c may be so formed as to extend straightly from the open side or end of the outer rotor 2 to the guide groove 25 with a greater number of air vent through-holes 27 being formed in the vicinity of the guide groove 25, as can be seen in Fig. 10B. In that case, the portions corresponding to the air vent through-holes 27 serve for the fiber collecting/bundling function, wherein the fibers moving slidingly on and along the fiber capturing surface 2c will be subjected to regulation or restriction at the locations corresponding to the air vent through-holes 27 under the action of suction exerted through the air vent through-holes 27, whereby a fiber bundle F is formed to be subsequently guided into the delivery passage 20 of the inner rotor 5.

(2) As the means for regulating or limiting the move of the fibers, there may be provided a plurality of nozzles for injecting air jets toward the fiber capturing surface 2c located closer to the open end of the outer rotor 2 than the fiber collecting/bundling portion (e.g. the fiber collecting/ bundling groove 7). In this conjunction, the compressed fluid or air to be fed to the inner rotor 5 may be supplied from a compressed air source installed externally of the housing 10 by way of a air feed passage formed in the boss portion 11, as is in the case of the apparatus disclosed in Japanese Unexamined Patent Application Publication No. 33226/1993 (JP-A-5-33226) filed by the same assignee as the present application.

(3) The number and the size of the discharge through-holes 9 as well as the distance therebetween may be changed appropriately, as occasion requires. Besides, the discharge holes may be formed in the bottom of the outer rotor 2, as indicated by reference numeral 9' in FIG. 1. Further, the air discharge hole 9 may be imparted with a self-discharge capability.

(4) The fiber collecting/bundling portion is never limited to the fiber collecting/bundling groove 7 which is not located in a same plane as the fiber capturing surface 2c but it may be provided on a same plane as the fiber capturing surface 2c, as in the case of the fiber collecting/bundling portion of the open-end spinning machine according to the third embodiment of the invention.

(5) The number and the size of the air vent through-holes 8, 24 and 27 as well as the distance therebetween may be changed appropriately, as the case may be. Furthermore, instead of forming the air vent through-holes in a plane extending orthogonally to the center axis of the rotor shaft 1, they may be so formed as to extend obliquely toward the open end of the outer rotor 2 or the bottom thereof.

Figure 11:
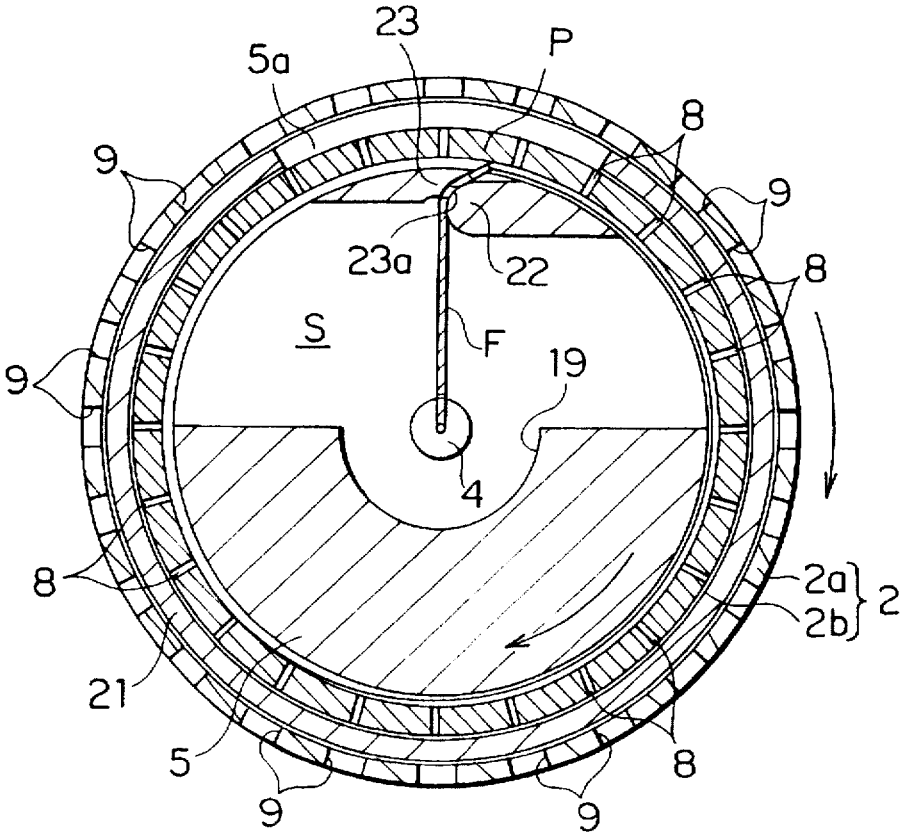
FIG. 11 is a fragmentary sectional view showing another version of the open-end spinning machine according to the invention.
Figure 12A:
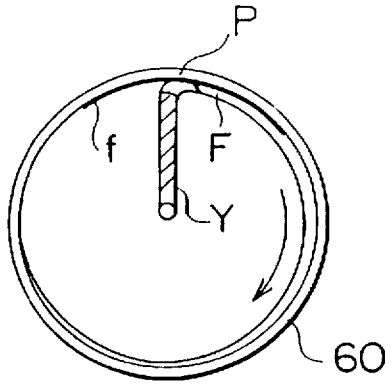
FIGS. 12A to 12C are schematic diagrams for illustrating undesirable phenomenon of fibers wound on a yarn during twisting thereof in an open-end spinning machine known heretofore.
Figure 12B:
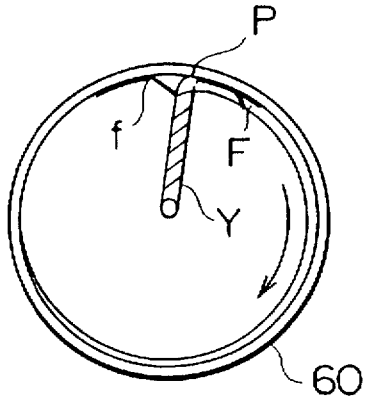
Figure 12C:
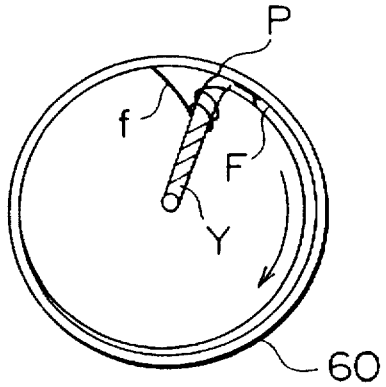

(6) The fiber bundle delivery passage 20 for guiding the fiber bundle F formed in the fiber collecting/ bundling groove 7 is not limited to the passage extending continuously to the yarn withdrawing passage 14. It is sufficient to provide some means which can serve for guiding the fiber bundle F in the vicinity of the fiber collecting/ bundling groove 7. By way of example, the guide 22 and the wall 23 may be provided in association with the inner rotor 5 so that an opened space S is formed between the guide 22 and the yarn withdrawing passage 14, as is illustrated in FIG. 11. Further, a twist propagation suppressing or preventing means may be provided at a position in the vicinity of the fiber collecting/bundling groove 7 of the inner rotor 5. In that case, the guide 22 and the wall 23 may be spared.

(7) Rate of the enforcive air discharge, i.e., a relation between the degree of vacuum of the negative pressure source and the pressure actually acting on the fiber bundle F at the fiber collecting/bundling portion may experimentally be determined beforehand. Further, flow rate of the enforcive air discharge may selectively be determined in dependence on the spinning conditions as desired. In that case, regulation or restriction of the fibers can be realized under more favorable conditions.

(8) The delivering hole (withdrawing hole) may be formed closer to the fiber collecting/bundling portion of the inner rotor 5 to thereby allow the invention to be applied to the machine for spinning the fiber bundle for a yarn while drafting the fiber bundle F.

(9) By modifying the flow rate of the enforcive air discharge in dependence on the spinning conditions as desired, the negative pressure actually effective may correspondingly be changed. In that case, the regulation or control of the fibers can be accomplished more appropriately or favorably.

Accordingly, all suitable modifications and equivalents may be resorted to, falling within the spirit and scope of the invention.

What is claimed is:

1. A rotor type open-end spinning machine comprising: an outer rotor having an open end, a closed end, and a cylindrical wall joined to said closed end, said cylindrical wall having a radially inner wall surface provided with a fiber collecting/bundling section at which fibers supplied in an opened state are collected and bundled to form a fiber bundle; an inner rotor disposed within said outer rotor and constructed and adapted to be positively driven independently of said outer rotor; and a yarn withdrawing passage for withdrawing a yarn from said inner rotor; said inner rotor having a delivery passage for receiving said fiber bundle from said fiber collecting/bundling section and guiding said fiber bundle into said yarn withdrawing passage, said delivery passage having a portion which communicates with an end of said yarn withdrawing passage; characterized in that said spinning machine further comprises means for regulating temporarily the movement of the fibers placed on said inner wall surface of said outer rotor which are moving on said inner wall surface of said outer rotor toward said fiber collecting/bundling section at least in the vicinity of said delivery passage in said inner rotor.

2. A spinning machine according to claim 1, characterized in that said means for regulating movement of the fibers includes: an annular negative-pressure chamber provided in association with said outer rotor radially outward of said cylindrical wall; a plurality of discharge holes formed in said outer rotor for providing communication between said negative-pressure chamber and the exterior of said outer rotor; a plurality of first air vent through-holes formed in said cylindrical wall in a circumferential direction with a predetermined distance therebetween for providing communication between a radially inner space of said outer rotor and said negative-pressure chamber; and a shield member carried by said inner rotor for covering all of said first air vent through-holes except for a predetermined number of said through-holes that are adjacent said delivery passage.

3. A spinning machine according to claim 2, characterized in that said inner rotor has an annular radially outwardly extending flange disposed in opposition to said closed end of said outer rotor, and said shield member is a plate-like member extending from a portion of a peripheral edge of said annular flange in a direction away from said closed end of said outer rotor.

4. A spinning machine according to claim 2, characterized in that said first plurality of air vent through-holes are located alongside said fiber collecting/bundling section on the side closer to said open end of said outer rotor; and a plurality of second circumferentially spaced air vent through-holes are formed in said cylindrical wall substantially centered within said fiber collecting/bundling section.

5. A spinning machine according to claim 2, characterized in that at least some of said discharge holes are formed through said closed end of said outer rotor.

6. A spinning machine according to claim 1, characterized in that said fiber collecting/bundling section is comprised of a recessed groove formed in said inner wall surface of said outer rotor.

7. A spinning machine according to claim 1, characterized in that said outer rotor has a peripheral wall joined at one end to said closed end, and said cylindrical wall has a smaller diameter than said peripheral wall and is supported reentrantly from the other end of said peripheral wall spaced radially inward from and concentric with said peripheral wall.

8. A rotor type open-end spinning machine comprising: an outer rotor having an open end, a closed end, and a cylindrical wall joined to said closed end, said cylindrical wall having a radially inner wall surface provided with a fiber collecting/bundling section at which fibers supplied in an opened state are collected and bundled to form a fiber bundle; an inner rotor disposed within said outer rotor and constructed and adapted to be positively driven independently of said outer rotor; and a yarn withdrawing passage for withdrawing a yarn from said inner rotor; said inner rotor having a delivery passage for receiving said fiber bundle from said fiber collecting/bundling section and guiding said fiber bundle into said yarn withdrawing passage, said delivery passage having a portion which communicates with an end of said yarn withdrawing passage; characterized in that said delivery passage in said inner rotor and said fiber collecting/bundling section of said inner wall surface are located, respectively, further from and closer to said open end of said outer rotor; the diameter of said inner wall surface decreases from said fiber collecting/bundling section toward said closed end of said outer rotor; and said inner wall surface is provided with a circumferential guide groove located in registration with said delivery passage for withdrawing the fiber bundle from said fiber collecting/bundling section and feeding it to said delivery passage.

9. A spinning machine according to claim 8, characterized in that a plurality of air vent through-holes are formed in said cylindrical wall of said outer rotor with a predetermined distance therebetween in a circumferential direction thereof located between said fiber collecting/bundling section of said outer rotor and said guide groove.

10. A spinning machine according to claim 9, characterized in that said inner annular surface of said outer rotor extending from said open end of said outer rotor to said guide groove is in the form of a surface of revolution where all of the elements of the surface are straight lines.

11. A rotor type open-end spinning machine comprising: an outer rotor having an open end, a closed end, and a cylindrical wall joined to said closed end, said cylindrical wall having a radially inner wall surface provided with a fiber collecting/bundling section at which fibers supplied in an opened state are collected and bundled to form a fiber bundle; an inner rotor disposed within said outer rotor and constructed and adapted to be positively driven independently of said outer rotor; and a yarn withdrawing passage for withdrawing a yarn from said inner rotor; said inner rotor having a delivery passage for receiving said fiber bundle from said fiber collecting/bundling section and guiding said fiber bundle into said yarn withdrawing passage, said delivery passage having a portion which communicates with an end of said yarn withdrawing passage; characterized in that said delivery passage in said inner rotor and said fiber collecting/bundling section of said inner wall surface are located, respectively, further from and closer to said open end of said outer rotor; said inner wall surface is provided with a circumferential guide groove located in registration with said delivery passage for withdrawing the fiber bundle from said fiber collecting/bundling section and feeding it to said delivery passage; a plurality of air vent through-holes are formed in said cylindrical wall of said outer rotor with a predetermined distance therebetween in a circumferential direction thereof located between said fiber collecting/bundling section of said outer rotor and said guide groove; said outer rotor and said inner rotor have coaxial center axes around which said rotors are rotatable; and said inner annular surface of said outer rotor has a right circular cylindrical region extending between said fiber collecting/bundling section and said guide groove.

* * * * *

UNITED STATES PATENT AND TRADEMARK OFFICE

CERTIFICATE OF CORRECTION

PATENT NO. : 5,765,359
DATED : June 16, 1998
INVENTOR(S) : Y. Kawai et al.

It is certified that error appears in the above-identified patent and that said Letters Patent is hereby corrected as shown below:

Column 2, line 30, after "illustrated" insert --in--.

Column 2, line 31, after "60" delete "in";
line 36, before "bending" insert --the--;
line 50, after "feel" delete "out".

Column 5, line 65, after "fibers", insert --being--.

Column 6, line 66, insert --,-- (comma) before "wherein".

Signed and Sealed this
Fifteenth Day of December, 1998

Bruce Lehman

*Attest:*

*Attesting Officer*

BRUCE LEHMAN

*Commissioner of Patents and Trademarks*